US005630864A

United States Patent [19]

Rierson

[11] Patent Number: 5,630,864

[45] Date of Patent: May 20, 1997

[54] METHOD OF PROCESSING ORE ON A TRAVELING GRATE

[76] Inventor: David W. Rierson, 13245 Oakhurst Dr., Elm Grove, Wis. 53122

[21] Appl. No.: 562,396

[22] Filed: Nov. 24, 1995

[51] Int. Cl.[6] ..... C22B 1/20

[52] U.S. Cl. ..... 75/755; 266/178

[58] Field of Search ..... 75/755–759; 266/178

[56] References Cited

U.S. PATENT DOCUMENTS 3,353,953 11/1967 Schwarz ..... 75/755
4,689,007 8/1987 Kilian et al. ..... 266/178

FOREIGN PATENT DOCUMENTS 1808020 4/1993 U.S.S.R. ..... 75/758

*Primary Examiner*—Melvyn Andrews

[57] ABSTRACT

A traveling gate system for treating mineral ores that incorporate a cooling zone intermediate to heating zones to enable the use of a longer gate chain and additional heating zones to further refine the heat treating process of a traveling gate system. In the cooling zone the gas is forced upward to initially contact the gate chain and cool it and prevent the chain parts from exceeding their high temperature limit. Appropriate gases such as air can be selected for the cooling gas to further enhance the treatment of the material being processed on the gate chain.

10 Claims, 1 Drawing Sheet

METHOD OF PROCESSING ORE ON A TRAVELING GRATE

FIELD OF THE INVENTION

This invention relates generally to processes for treating mineral ores such as ilmenite, manganese and iron, and particularly to processes for drying and heat treating agglomerates of these ores from finely divided oxides or concentrates thereof such as magnetite iron ore produced from taconites.

More specifically, the invention relates to the preparation of iron ore for use in a blast furnace or other reducing operations where the ore is either formed into pellets or some other type of agglomerate which are then indurated or hardened by heating to high temperature.

BACKGROUND OF THE INVENTION

As an example, iron ore which has been separated from the earthen substances with which it occurs in the mine, is commonly prepared for feed to a blast furnace by forming it into green pellets then feeding the pellets so formed onto a traveling grate machine where the pellets are dried, preheated, and indurated at a high temperature. In some cases the pellets may then be transferred to some other device such as a rotary kiln and then cooled. The present invention desirably makes use of a process and apparatus as disclosed in Phelps & Anthes U.S. Pat. No. 3,172,754 dated Mar. 9, 1965 with slight modifications.

As is common in apparatus of this kind, the traveling grate is made up of a succession of chain castings or pallets assembled into a continuous conveyor, which moves horizontally through a series of zones made up of furnace chambers above the grate chain and a succession of windbox chambers beneath the grate's chain. The traveling grate chain travels through the furnace chambers then over a head shaft then under the respective windboxes through ambient air then back to its starting point. At the discharge end of the grate the pellets can be fed into a rotary kiln for additional heating or the pellets can be cooled by air being forced upwardly through the bed and discharged into a bin for storage.

While I specifically referred to a pelletizing ore method, essentially the same procedure is followed where the ore is supplied onto the traveling grate chain without being pelletized and this invention is applicable to heat induration by other processes such as sintering.

The process of this invention has, as a starting material, finely ground iron ore concentrates or other fines such as ore dust in a moist condition such as are generally produced by known iron ore benification processes or particularly magnetic concentrations of magnetite and flotation of non-magnetic ores.

The finely ground, moist ore concentrates are readily formed into small agglomerates or green water bound pellets by such apparatus as bailing drums and pelletizing discs fully described in U.S. Pat. No. 1,994,718. The pelletization is controlled so it can produce small, ball-like green pellets in sizes ranging from one-quarter of an inch to one inch in diameter. It has been found that a layer of about eight to thirty inches deep of pellets on the grate will give good results if the pellets average in size between three-eights and three-quarters of an inch in diameter.

The bed of green pellets formed in the previous step are placed on the traveling grate chain as it enters the first furnace chamber and are initially subjected to an up or down draft of moderately heated drying gas such as air. There may be a second drying chamber through which the still moist pellets are conveyed. In the next furnace chamber the pellets are subjected to a downdraft of flame heated gas in the neighborhood of 1800 degrees fahrenheit. In this step of the process the pellets at the bottom of the bed can reach a temperature approximately 300 degrees fahrenheit. The bed of material on the traveling grate chain is subjected to additional heating in subsequent furnace chambers until the material is hardened to the proper degree and all other processing has been completed. At that point the pellets are deposited or discharged into a device such as a rotary kiln for further treatment, or cooled and deposited in a storage bin.

A limitation on the use of this type of a process is the temperature that the grate chain material can withstand before yielding and failure. As the grate chain progresses through the various furnace chambers, more and more heat is applied to the bed of pellets until the temperature of the grate chain approaches its limiting point and the process has to stop, or as in most commercial applications the ore is transferred off the grate for further treatment. This limits the length of the grate that can be used or the temperature of the gas in the furnace used for heating the ore. A typical method of this type is shown in U.S. Pat. No. 3,285,735 D. D. Phelps. Another example of pertinent prior art is U.S. Pat. No. 2,750,272 O. G. Lellep.

OBJECTS OF THE INVENTION

The concepts of this invention are applicable to heat treatment of any material but will be explained in detail in connection with the treatment of iron ore.

It is the object of this invention to provide a new and improved heat treating process for ores such as iron ore or fines such as dust produced in industrial processes.

Another object of the invention is to provide a new and improved process for heat treating ore that enables the use of a longer traveling grate and/or hotter processing gas temperature.

DESCRIPTION OF THE DRAWING

For convenience and clarity, the process will be further described as proposed to be continuously carried out on a traveling grate type machine shown on the following schematic drawing.

Figure 1:
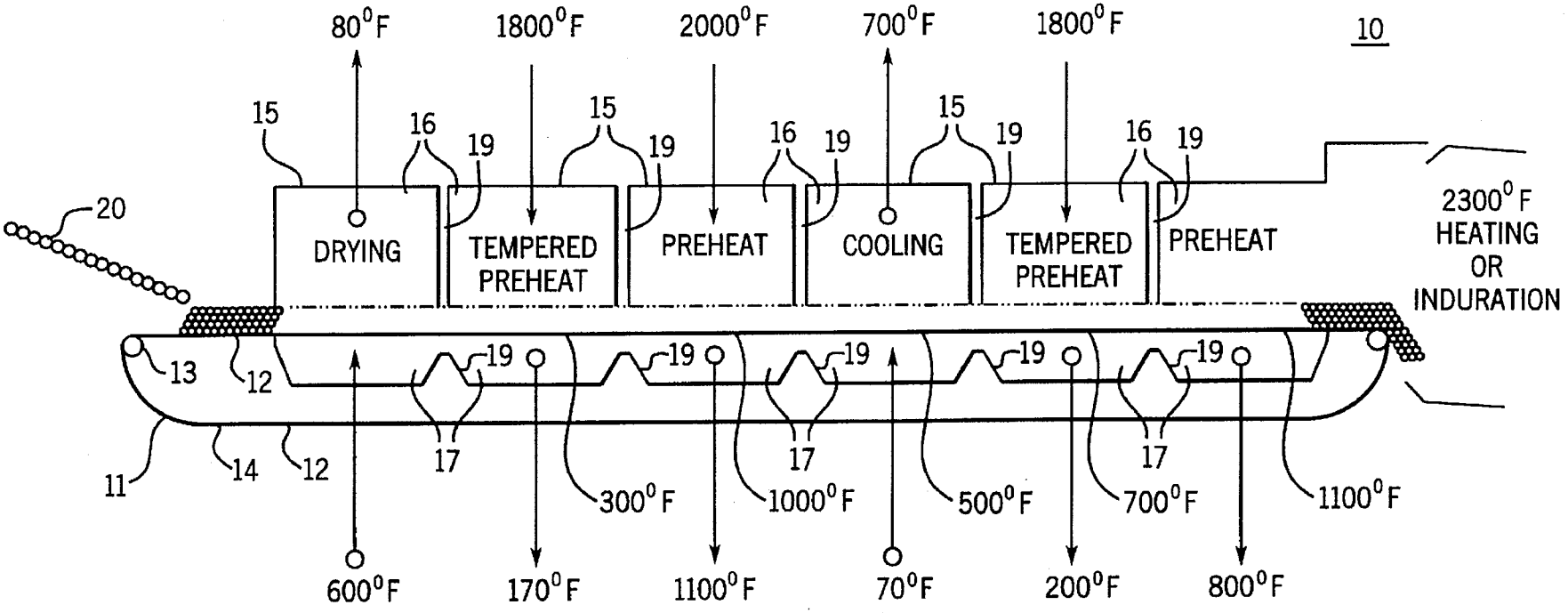
FIG. 1 shows an elevation section of a traveling grate including furnace and windbox chambers suitable for demonstrating the process.

The traveling grate 10 is a static bed processor. The grate chain 11 is made up of a series of connected castings or pallets 12 driven by sprockets 13 engaging chain links 14 and is continuously pulled through a series of zones or furnace chambers. The furnace chambers are separated from adjacent chambers by permanent or movable refractory baffle walls 17. The zones are both above and below the chain 11 which supports and conveys the bed of material to be treated. The above chambers are referred to as furnaces, and the below bed chambers are referred to as windboxes.

The traveling grate's endless conveyor chain is made of alloy steel construction and has a temperature limitation consistent with the chemistry of the alloyed parts. In many instances the heat contained in the gas passing through the furnace chamber and the material bed raises the temperature at the bottom of the bed to the point where the temperature could exceed the limitation of the grate chain. Thus steps have to be integrated into the processing cycle to prevent the grate chain parts from exceeding their high temperature limit.

In general, drying of the material in the form of pellets or other solids takes place in the first zones of the traveling grate machine. In these zones either updraft or downdraft gas flows through the bed of material and the grate chain at relatively low temperatures. Once the pellets or other material is dry, hotter gases in subsequent furnace chambers may be used with reduced concern over the material's sensitivity to exposure to hot gas crossflow. Subsequent temperatures of hot gas is ultimately determined by the material's sensitivity and the limitation of the grate's chain.

When processing iron ore pellets for example, the final furnace chambers uses downdraft gas at approximately 2300 degrees fahrenheit. As gas progresses through the bed of material on the grate's chain, the pellets are heated and the gas is cooled. The grate chain is continuously heated by the residual heat in the gas stream which flows into the windbox chambers. Once the temperature of the grate's chain reaches its temperature limitation consistent with the metallurgy of the specific chain's construction which in most cases is approximately 120 degrees fahrenheit, the heating cycle should end and the material on the bed should be discharged.

The speed of the traveling grate chain, the length of the various furnace chambers and the depth of the pellets on the grate's chain determine the temperature of the pellets at the bottom of the pellet bed and the grate's chain.

Depending on the type of solids being treated and the results desired to be accomplished, there can be several zones at significantly different temperatures. To provide more flexibility to accomplish the desired heat treatment and to improve the results of prior art machines, this invention contemplates the use of cooling gases forced upwardly in a zone between heating zones to reduce the temperature of the grate's chain and thereby enable the grate machine to be lengthened and to travel through the chambers at higher temperatures without having the grate chain fail. In addition, by selecting the type of cooling gas being used such as air or oxygen, significant physical enhancements can be made to the solids being processed by the traveling grate. For example, if an oxidizing gas such as air or oxygen is used, the material could be further oxidized in that zone. If a reducing gas such as carbon monoxide or hydrogen is used, it can assist in removing certain impurities such as zinc, lead, cadmium and also reduce oxides of iron, chromium, nickel, manganese and other metallic oxides.

After the grate's chain travels through a cooling chamber, the temperature of the gas in the succeeding heating chamber can be increased significantly to further process the material on the bed of the grate.

Referring more specifically to the drawing, the traveling grate 10 consists of a continuous chain 11 of pallets traveling through a series of zones 15 and returning beneath the zones back to its starting point. The material to be treated is deposited at the feed end of the grate chain 11 from an appropriate feeding system. The zones 15 are longitudinally spaced along the travel of the grate chain 11, and have upper and lower sections which are referred to as furnace chambers 16 and windbox chambers 17 separated by refractory baffle walls 19. In the first zone adjacent the feed end of the gate chain identified as a drying zone in which gas at a temperature of approximately 600 degrees fahrenheit is forced to flow though the grate chain 11 and the bed of material. In the second zone, gas at approximately 1800 degrees fahrenheit is forced downward through the bed of material and the grate chain in what is identified as a tempered preheat zone. In this zone the temperature of the grate chain may rise to 300 degrees fahrenheit. In the next zone identified in the drawing as a preheat zone, heating gas of 2000 degrees fahrenheit is forced downward through the bed of material. The gas emerging from the bottom of this zone is at 1100 degrees fahrenheit and the temperature of the grate chain approaches 1000 degrees fahrenheit. At this point the gate chain is approaching a point where it would yield or fail under additional heating. Therefore, in the next zone identified as a cooling zone, gas is forced upwardly through the gate chain and the bed of material at a temperature of approximately 70 degrees fahrenheit. The gas emerging from the top of the bed of material in this zone is at 700 degrees fahrenheit and the temperature of the grate chain is reduced to approximately 500 degrees fahrenheit. In the next zone, also identified as tempered preheat, gas at 1800 degrees fahrenheit is forced downwardly through the bed of material and the grate chain. The grate chain in this portion of the process reaches approximately 700 degrees fahrenheit. In the last zone illustrated, gas of approximately 2300 degrees fahrenheit is forced downwardly through the bed of material and the grate chain. As shown, the temperature of the grate chain at this point approaches 1100 degrees fahrenheit.

Although not shown in the drawings, it is contemplated that additional cooling zones could be inserted between adjacent heating zones to reduce the temperature of the grate chain at that point and enable the traveling grate machine to be lengthened so that more heating zones could be added to the process to further enhance the metallurgical treatment of the material being processed by the grate.

Although the invention has been described herein with a certain degree of particularity, it is understood that the present disclosure has been made only as an example and that the scope of the invention is defined by what is hereinafter claimed.

The embodiments of this invention in which exclusive property or privilege is claimed are defined as follows:

1. The method of treating material that is transported on a continuous chain of a traveling grate through a series of longitudinally spaced furnace zones separated by baffle walls comprising the steps of a. loading material to be treated onto said traveling grate chain near the end of said traveling grate where said chain is moving into the first of said furnace zones;

b. forcing a heated gas through said chain and material in the first zone;

c. forcing a heated gas downward through said material and said chain in the second zone;

d. forcing a cooling gas upward through said chain and said material in a third zone;

e. forcing a heated gas downward through said material and said chain in a fourth zone; and f. transferring said material from said grate chain.

2. The method of claim 1 in which said material is iron ore.

3. The method of claim 1 in which said material is mineral ores is ilmenite or manganese.

4. The method of claim 1 in which the heated gas in said first zone is approximately 600 degrees Fahrenheit.

5. The method of claim 4 in which the heated gas in said second zone is approximately 1800 degrees Fahrenheit.

6. The method of claim 5 in which the cooling gas in said third zone is approximately 70 degrees Fahrenheit.

7. The method of claim 6 in which the heating gas in said fourth zone is approximately 2300 degrees Fahrenheit.

8. The method of claim 1 in which the cooling gas in zone three is an oxidizing gas.

9. The method of claim 1 in which the cooling gas in zone three is a reducing gas.

10. The method of treating material that is transported on a continuous chain of a traveling grate through a series of longitudinally spaced furnace zones separated by baffle walls comprising the steps of:

a. loading agglomerates of material to be treated onto said traveling grate chain;

b. forcing a heated gas downward through said material and said chain in at least one of said furnace zones;

c. forcing a cooling gas upward through said chain and said material in a furnace zone after the zone in which heated gas is forced downward through said chain d. forcing a heated gas downward through said material and said chain in a furnace zone after said zone in which said cooling gas was forced upward through said chain; and e. transferring said material from said grate chain.

* * * * *